US010032597B2

(12) United States Patent
Ohashi et al.

(10) Patent No.: US 10,032,597 B2
(45) Date of Patent: Jul. 24, 2018

(54) X-RAY GENERATING TUBE, X-RAY GENERATING APPARATUS, X-RAY IMAGING SYSTEM, AND ANODE USED THEREFOR

(71) Applicant: CANON KABUSHIKI KAISHA, Tokyo (JP)

(72) Inventors: Yasuo Ohashi, Kawasaki (JP); Kazuyuki Ueda, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 373 days.

(21) Appl. No.: 14/791,943

(22) Filed: Jul. 6, 2015

(65) Prior Publication Data

US 2016/0020060 A1 Jan. 21, 2016

(30) Foreign Application Priority Data

Jul. 18, 2014 (JP) ..... 2014-147339
Jun. 12, 2015 (JP) ..... 2015-119318

(51) Int. Cl.

| | |
|---|---|
| ***H01J 35/00*** | (2006.01) |
| ***H01J 35/08*** | (2006.01) |
| *H01J 35/10* | (2006.01) |
| *H01J 35/12* | (2006.01) |

(52) U.S. Cl.

CPC ..... *H01J 35/08* (2013.01); *H01J 35/108* (2013.01); *H01J 35/12* (2013.01); *H01J 2235/087* (2013.01)

(58) Field of Classification Search

CPC ..... G01N 23/04; H01J 2235/087; H01J 2235/166; H01J 2235/186; H01J 35/08; H01J 35/16; H01J 35/165; H01J 35/18; H01J 35/108; H01J 35/12; H01J 35/101; H01J 35/14; H01J 2235/1013; H01J 2235/081; H01J 2235/168; H01J 35/32; H01J 35/06; H01J 35/02; H01J 2235/084; H01J 2235/16; H01J 35/10; H01J 2235/1204; H01J 2235/1216; H01J 2235/00

USPC ..... 378/121, 143, 124, 127

See application file for complete search history.

(56) References Cited

U.S. PATENT DOCUMENTS

| | | | | |
|---|---|---|---|---|
| 6,064,718 A * | 5/2000 | Holland | H01J 35/00 | 378/119 |
| 7,526,069 B2 * | 4/2009 | Matsumura | H01J 35/18 | 378/119 |
| 2013/0328184 A1 * | 12/2013 | Iwayama | H01L 23/15 | 257/712 |
| 2014/0140480 A1 | 5/2014 | Ogura et al. | | |
| 2014/0140486 A1 | 5/2014 | Yanagisawa et al. | | |

FOREIGN PATENT DOCUMENTS

| | | |
|---|---|---|
| JP | 2013-51153 A | 3/2013 |
| JP | 2013-55041 A | 3/2013 |

* cited by examiner

*Primary Examiner* — Irakli Kiknadze
(74) *Attorney, Agent, or Firm* — Fitzpatrick, Cella, Harper & Scinto

(57) ABSTRACT

An anode member includes a first metal tube and a second metal tube having a coefficient of thermal expansion that is larger than that of the first metal tube. A peripheral portion of a target is bonded to the anode member via a bonding material that is arranged so as to extend over the first metal tube and the second metal tube.

22 Claims, 6 Drawing Sheets

X-RAY GENERATING TUBE, X-RAY GENERATING APPARATUS, X-RAY IMAGING SYSTEM, AND ANODE USED THEREFOR

BACKGROUND OF THE INVENTION

Field of the Invention

The present invention relates to a transmission X-ray generating tube, an X-ray generating apparatus, and an X-ray imaging system with an anode, and an anode used therefor, the anode including a target for generating an X-ray through irradiation of an electron beam and a tubular anode member with an opening for holding the target.

Description of the Related Art

A transmission X-ray generating tube including a transmission target is known. The transmission target uses an X-ray emitted from a side thereof, which is opposite to a side, on which an electron beam enters the target. The transmission X-ray generating tube may include a target made of diamond as an end window of the X-ray generating tube. Such a transmission X-ray generating tube has advantageous features in that a radiation angle can become wider, heat dissipation performance can become higher, and an X-ray generating apparatus can be downsized. The target in such a transmission X-ray generating tube is hermetically bonded to an anode member via a bonding material such as a silver brazing material, an Ag—Sn based brazing material, or an Au—Sn based brazing material formed on a periphery of the target. Such a brazing material is adopted that has a melting point of from 200° C. to a temperature of the anode member when operated or higher. When the Ag—Sn based brazing material is used, by controlling composition ratios therein or using a ternary or higher brazing material, material design of a wide range of melting points is possible (100° C. to 900° C.)

In Japanese Patent Application Laid-Open No. 2013-51153, there is disclosed a transmission X-ray generating tube including a tubular anode member having opening diameter with a distribution and a transmission target held by the anode member. Further, in Japanese Patent Application Laid-Open No. 2013-55041, there is disclosed an X-ray generating tube including a tubular anode member formed of a member having a high X-ray blocking property and a thermally conductive member, and a transmission target held by the anode member. In such an X-ray generating tube including the transmission target as an end window, when X-ray generating operation is repeated, a desired tube current sometimes cannot be obtained and hence it is difficult to secure a necessary X-ray output. A transmission X-ray generating tube that can obtain a stable X-ray output has been required.

SUMMARY OF THE INVENTION

However, both of the structures disclosed in Japanese Patent Application Laid-Open No. 2013-51153 and in Japanese Patent Application Laid-Open No. 2013-55041 have the following problem. That is, as X-ray generating operation and X-ray generation stop operation are repeated, vacuum leakage is sometimes caused. When such vacuum leakage is caused, a problem arises that a mean free path of electrons in the atmosphere in the X-ray generating tube is reduced, the tube current is reduced, and the X-ray output is reduced. Thus, the structures are required to be improved.

Review by inventors of the present invention revealed that a cause of reduction in X-ray output described above was a stress amplitude of the anode accompanying the repeated operation of the X-ray generating tube. Specifically, the cause of the reduction in X-ray output was identified as a circumferential tensile stress produced in a bonding material for bonding together the transmission target and the anode member.

It is an object of the present invention to inhibit vacuum leakage from a bonding material for hermetically bonding a target to a surrounding member due to a crack that develops because of a difference in coefficient of thermal expansion between the target and the bonding material, and to increase durability of an X-ray generating tube, and by extension, an X-ray generating apparatus and an X-ray imaging system, and an anode therein.

In order to achieve the above-mentioned object, according to a first aspect of the present invention, there is provided a transmission X-ray generating tube, including an anode including: a target for generating an X-ray through irradiation of an electron beam from an electron emitting source; and a tubular anode member having an opening for holding the target, the tubular anode member including a first metal tube, and a second metal tube fixed to the first metal tube and having a coefficient of thermal expansion that is larger than a coefficient of thermal expansion of the first metal tube, in which a peripheral portion of the target is bonded to the tubular anode member via a bonding material arranged so as to extend over the first metal tube and the second metal tube.

According to a second aspect of the present invention, there is provided an X-ray generating apparatus, including:

a transmission X-ray generating tube; and a tube voltage circuit, in which the transmission X-ray generating tube having an anode including: a target for generating an X-ray through irradiation of an electron beam from an electron emitting source; and a tubular anode member having an opening for holding the target, the tubular anode member including a first metal tube, and a second metal tube fixed to the first metal tube and having a coefficient of thermal expansion that is larger than a coefficient of thermal expansion of the first metal tube, in which a peripheral portion of the target is bonded to the tubular anode member via a bonding material arranged so as to extend over the first metal tube and the second metal tube, in which the tube voltage circuit is electrically connected to each of the target and the electron emitting source, for applying a tube voltage between the target and the electron emitting source.

According to a third aspect of the present invention, there is provided an X-ray imaging system, including:

an X-ray generating apparatus;

an X-ray detector for detecting an X-ray that is emitted from the X-ray generating apparatus and passes through a subject; and a system control device for integrally controlling the X-ray generating apparatus and the X-ray detector, in which the X-ray generating apparatus, including:

a transmission X-ray generating tube; and a tube voltage circuit;

in which the transmission X-ray generating tube having an anode including: a target for generating an X-ray through irradiation of an electron beam from an electron emitting source; and a tubular anode member having an opening for holding the target, the tubular anode member including a first metal tube, and a second metal tube fixed to the first metal tube and having a coefficient of thermal expansion that is larger than a coefficient of thermal expansion of the first metal tube, in which a peripheral portion of the target is bonded to the tubular anode member via a bonding material arranged so as to extend over the first metal tube and the second metal tube, in which the tube voltage circuit is electrically connected to each of the target and the electron emitting source, for applying a tube voltage between the target and the electron emitting source.

Further, according to a fourth aspect of the present invention, there is provided an anode for an X-ray generating tube to be used in a transmission X-ray generating tube, the anode including: a target for generating an X-ray through irradiation of an electron beam from an electron emitting source; and a tubular anode member having an opening for holding the target, the tubular anode member including a first metal tube, and a second metal tube fixed to the first metal tube and having a coefficient of thermal expansion that is larger than a coefficient of thermal expansion of the first metal tube, in which a peripheral portion of the target is bonded to the tubular anode member via a bonding material arranged so as to extend over the first metal tube and the second metal tube.

Further features of the present invention will become apparent from the following description of exemplary embodiments with reference to the attached drawings.

DESCRIPTION OF THE EMBODIMENTS

Embodiments of the present invention are described in the following with reference to the attached drawings, but the present invention is not limited to these embodiments. Note that, well-known or publicly known technologies in the art are to be applied to parts that are not specifically illustrated or described herein.

<Anode and X-Ray Generating Tube>

Figure 1A:
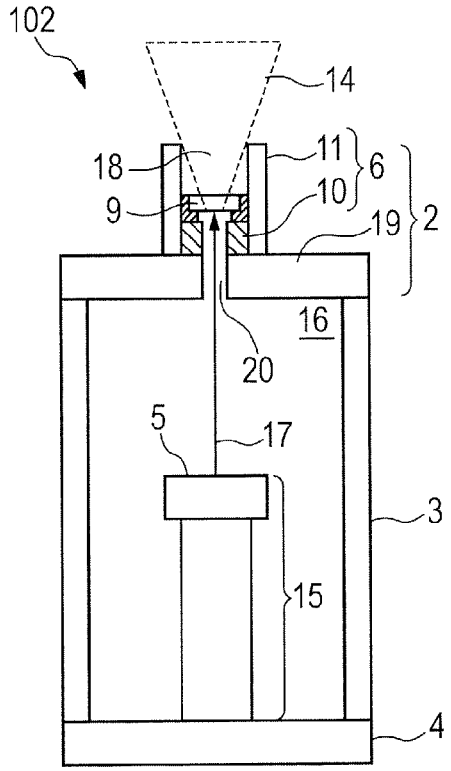
FIG. 1A is an illustration of an X-ray generating tube according to an embodiment of the present invention.
Figure 1B:
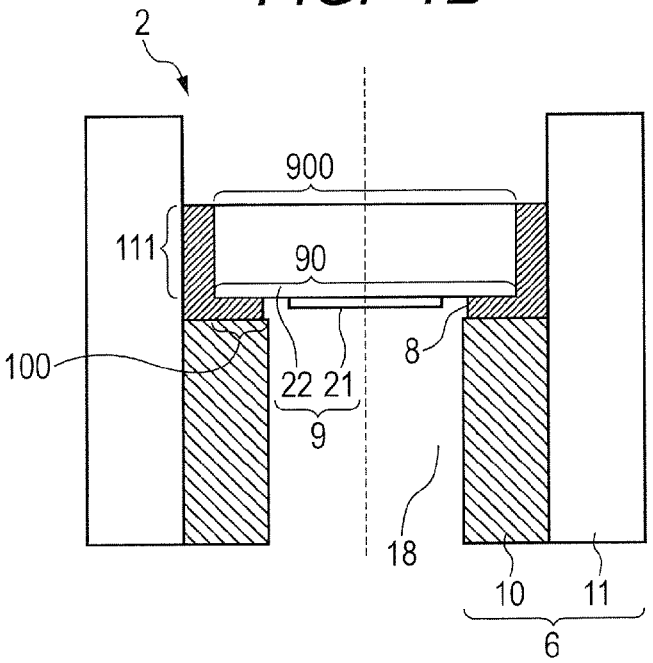
FIG. 1B is an enlarged sectional view for illustrating a basic form of an anode according to a first embodiment of the present invention used in the X-ray generating tube illustrated in FIG. 1A.

FIG. 1A is an illustration of a transmission X-ray generating tube 102 that includes an electron emission source 15 and a target 9 opposed to the electron emission source 15 according to an embodiment of the present invention. FIG. 1B is an enlarged illustration of an anode 2 according to a first embodiment used in the X-ray generating tube 102.

The X-ray generating tube 102 according to this embodiment includes a cathode 4, an electron emitting source 5 connected to the cathode 4, the anode 2, and an insulating tube 3 sandwiched between the anode 2 and the cathode 4. The anode 2 includes the target 9 for generating an X-ray through irradiation of electrons, a tubular anode member 6 having an opening 18 that is closed by the target 9, and an anode plate 19. In the X-ray generating tube 102 of this embodiment, an X-ray flux 14 is generated by irradiating the target 9 with an electron beam 17 emitted from the electron emitting source 5 included in the electron emission source 15 so that the electron beam 17 collides with the target 9.

As illustrated in FIG. 1B, the target 9 includes a target layer 21 for generating an X-ray through irradiation of the electron beam 17, and a target base member 22 for supporting the target layer 21. A surface of the target 9 on a side on which the target layer 21 is formed is an electron irradiation surface 90 to be irradiated with the electron beam. A surface of the target 9 opposite to the surface on which the target layer 21 is formed is an X-ray emission surface 900 for emitting an X-ray.

The target layer 21 is an X-ray generation source for emitting a necessary kind of ray by appropriately selecting a material contained in the target layer and a thickness thereof together with a tube voltage Va. As a material of the target layer, for example, a metal material having an atomic number of 40 or more such as Mo (molybdenum), Ta (tantalum), W (tungsten), or the like can be contained. The target layer 21 can be formed on the target base member 22 by an arbitrary film forming method such as vapor deposition or sputtering.

The target base member 22 is formed of a material that transmits an X-ray to a high degree and is highly refractory such as beryllium, natural diamond, or artificial diamond. Of those, a diamond substrate formed of artificial diamond by a high pressure and high temperature method or chemical vapor deposition is preferred from the viewpoint of heat dissipation, reproducibility, uniformity, costs, and the like. It is preferred that the target base member 22 have an outer shape of a rectangular parallelepiped or a disk. The target base member 22 in the shape of a disk can have a diameter of 2 mm or more and 10 mm or less. Further, a lower limit and an upper limit of a thickness of the target base member 22 depend on strength, thermal conductivity in a direction in parallel with the target layer 21, and radiation transmittance, and the thickness is 0.3 mm or more and 4.0 mm or less. In the case where the target base member 22 is in the shape of a rectangular parallelepiped, the range of the diameter described above is replaced with a length of a shorter side and a length of a longer side of a surface of the rectangular parallelepiped. The target base member 22 not only acts as a transmission window for taking an X-ray generated at the target layer 21 out of the X-ray generating tube 102, but also acts as a member forming a vacuum container together with other members.

The anode member 6 not only has the function of defining an anode potential of the target layer 21 but also has the function of holding the target 9. The anode member 6 and the target 9 are bonded together via a bonding material 8. Further, the anode member 6 is electrically connected to the target layer 21 via an electrode (not shown).

The anode member 6 can have the function of blocking an X-ray by being formed of a material having a high specific gravity. From the viewpoint of downsizing the anode member 6, it is preferred that a material forming the anode member 6 have a mass attenuation coefficient $\mu/\rho$ [$m^2/kg$] and a density $\rho$ [$kg/m^3$] so that a product thereof is large. Further, from the viewpoint of further downsizing, it is preferred that a metallic element having specific absorption edge energy be appropriately selected as a material forming the anode member 6, based on the kind of the X-ray generated from the target layer 21. The anode member 6 can contain Cu, Ag, Mo, Ta, W, or the like, and can contain the same metallic element as a target metal contained in the target layer 21. The mass attenuation coefficient depends on the voltage, and for example, when the voltage is 100 kV, W: 0.4438, Ta: 0.4302, Mo: 0.1096, Ag: 0.1470, and Cu: 0.04584 [$m^2/kg$]. With regard to a linear attenuation coefficient $\mu$, which is a product of the mass attenuation coefficient and the density, W: 8565.3, Ta: 7162.8, Mo: 1120.1, Ag: 1543.5, and Cu: 410.7 [$m^{-1}$]. The anode member 6 is in a tubular shape so as to surround the target 9, and thus functions as a forward shielding member that defines a range of an emission angle of an X-ray emitted from the target layer 21 to shape the X-ray into the X-ray flux 14. Further, the anode member 6 functions as a rear block that limits a range in which reflected and backscattered electrons (not shown) or a backscattered X-ray (not shown) reach from the target layer 21 toward the electron emission source 15.

The bonding material 8 is, for example, a brazing material of various kinds such as a silver brazing material, gold brazing material, or a copper brazing material, solder, or the like. Members to be bonded can be bonded together by sandwiching the bonding material 8 in a heat-softened state between the members to be bonded and then cooling the sandwiched bonding material 8. It is preferred that the bonding material 8 be a brazing material from the viewpoint of handleability and bonding power. Among brazing materials, a silver brazing material is preferred, because brazing can be carried out at a relatively low brazing temperature that is high enough to prevent remelting even if the vacuum container is fired at high temperature in a manufacturing step after the brazing.

Figure 5:
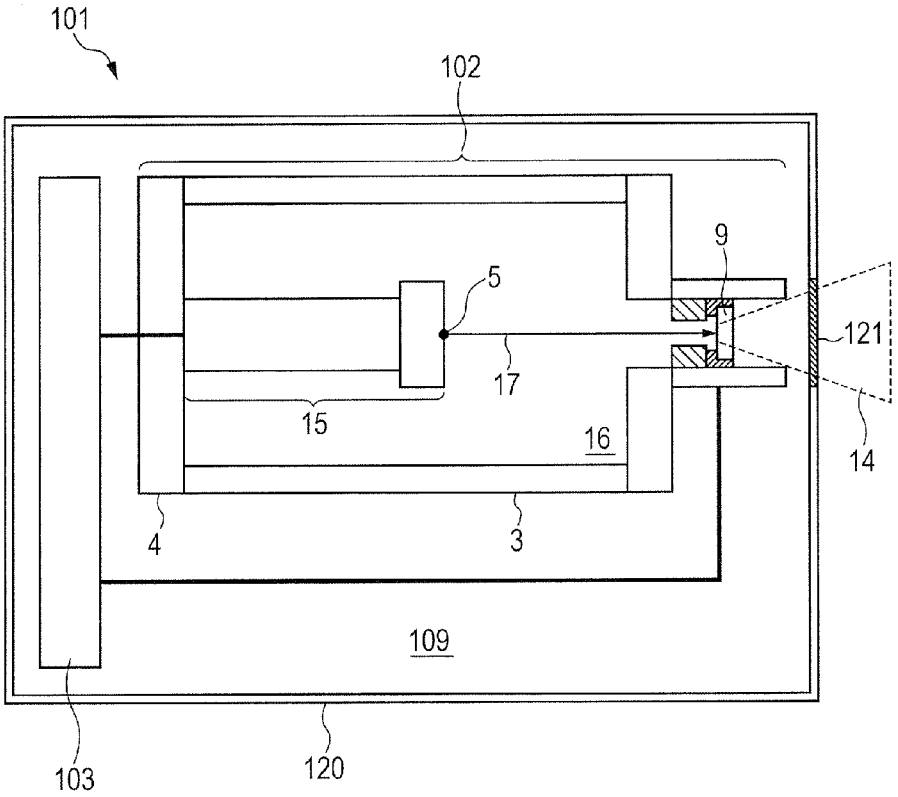
FIG. 5 is a schematic structural view of an X-ray generating apparatus including the X-ray generating tube according to the present invention.

Electrons contained in the electron beam 17 are accelerated to have incident energy necessary for generating an X-ray by an electric field between the electron emission source 15 and the target 9. The accelerating electric field is incorporated when an X-ray generating apparatus 101 illustrated in FIG. 5 is used, and the accelerating electric field is formed in a fully enclosed space 16 in the X-ray generating tube 102 by a tube voltage circuit 103 for outputting the tube voltage Va applied between the target 9 and the electron emitting source 5.

A trunk of the X-ray generating tube 102 is formed by the insulating tube 3 that is formed for electrical insulation purposes between the electron emission source 15 defined at a cathode potential and the target layer 21 defined at the anode potential. The insulating tube 3 is formed of an insulating material such as a glass material or a ceramic material. The insulating tube 3 can also have the function of defining a distance between the electron emission source 15 and the target layer 21.

The fully enclosed space 16 in the X-ray generating tube 102 id depressurized so that the electron emission source 15 functions. It is preferred that the inside of the X-ray generating tube 102 have a vacuum of $10^{-8}$ Pa or more and $10^{-4}$ Pa or less, and, from the viewpoint of the life of the electron emission source 15, it is further preferred that the vacuum be $10^{-8}$ Pa or more and $10^{-6}$ Pa or less. It is preferred that, as a vacuum container, the X-ray generating tube 102 have hermeticity for maintaining such a vacuum and a durability against atmospheric pressure. After a vacuum is produced using a vacuum pump (not shown) via a discharge pipe (not shown), the inside of the X-ray generating tube 102 can be depressurized by sealing the discharge pipe. Further, for the purpose of maintaining the vacuum degree, a getter (not shown) may be arranged in the X-ray generating tube 102.

The electron emission source 15 is arranged so as to be opposed to the target layer 21 of the target 9. As the electron emission source 15, for example, a tungsten filament, a hot cathode such as an impregnated cathode, or a cold cathode such as a carbon nanotube can be used. For the purpose of controlling a beam diameter, an electron current density, and on/off of the electron beam 17, the electron emission source 15 can include a grid electrode and an electrostatic lens electrode (not shown).

Basic structures of the anode 2 and the X-ray generating tube 102 are as described above. According to the present invention, in order to prevent a crack from developing due to a circumferential tensile stress of the target 9 that is applied to the bonding material 8 as the state thereof transitions from a heated state when bonded to a cooled and contracted state, the anode 2 has a structure as described below.

First Embodiment

A basic form of the anode for the X-ray generating tube according to a first embodiment of the present invention is described with reference to FIG. 1B and partly with reference to FIG. 1A.

In the anode 2 according to the first embodiment, the anode member 6 includes a first metal tube 10 and a second metal tube 11. A peripheral portion of the target 9 is bonded to the anode member 6 via the bonding material 8 arranged so as to extend over the first metal tube 10 and the second metal tube 11. The second metal tube 11 has a coefficient of thermal expansion that is larger than that of the first metal tube 10. Further, the target 9 is bonded to an inside of the opening 18 in the anode member 6.

Further, the first metal tube 10 is arranged inside the second metal tube 11, and an inner surface of the second metal tube 11 and an outer surface of the first metal tube 10 are connected to each other at a portion in a tube axial direction of the second metal tube 11 so that the first metal tube 10 and the second metal tube 11 do not move relative to each other at a melting point of the bonding material 8. The first metal tube 10 and the second metal tube 11 are connected to each other by fitting using their difference in coefficient of thermal expansion, heat seal, bonding via a bonding material having a melting point that is higher than that of the bonding material 8, casting, or the like. The first metal tube 10 and the second metal tube 11 are formed on an outer surface side of the anode plate 19 so as to surround a through hole 20 formed in the anode plate 19. The first metal tube 10 is shorter than the second metal tube 11 in the tube axial direction of the second metal tube 11, and a front end (X-ray emission side) of the first metal tube 10 is recessed from a front end of the second metal tube 11. Therefore, the second metal tube 11 has a region in which the inner surface thereof on the front end side is not covered with the first metal tube 10. Any one or both of a rear end of the first metal tube 10 and a rear end of the second metal tube 11 (electron beam incident side and opposite to the X-ray emission side) are in contact with the outer surface of the anode plate 19. A front end side of the anode member 6 is formed only of the second metal tube 11, and the remaining portion has a dual structure formed of the first metal tube 10 and the second metal tube 11, and an inner step is formed using a level difference therebetween by an end face of the first metal tube 10 on the front end side.

The target 9 is formed inside the second metal tube 11 under a state in which the target layer 21 is on the fully enclosed space 16 side of the X-ray generating tube 102. The target 9 is bonded to the anode member 6 via the bonding material 8 intervening in a region between a circumferential side surface of the target base member 22 and a region inside the second metal tube 11 that is not covered with the first metal tube 10, and a region between an outer peripheral portion of a surface of the target 9 on the electron beam irradiation side and the end face of the first metal tube 10 on the front end side. Specifically, the target 9 is bonded to the anode member 6 via the bonding material 8 that is arranged so as to extend over the first metal tube 10 and the second metal tube 11.

As illustrated in FIG. 1B, the electron irradiation surface 90 of the target 9 is one of two surfaces, which are opposed to each other and border the circumferential side surface of the target base member 22 along circles, respectively, the one surface having a portion to be irradiated with the electron beam (surface on which the target layer 21 is formed). Further, as illustrated in FIG. 1A, the electron irradiation surface 90 of the target 9 is the other of the two surfaces, which are opposed to each other and border the circumferential side surface of the target base member 22 along circles, respectively, the other surface being on a side in contact with the fully enclosed space 16 depressurized to a vacuum.

The end face of the first metal tube 10 on the front end side in this embodiment has a step 100 that is opposed to the target 9 in the tube axial direction and overlaps the target 9 in a tube radial direction. Further, the inner surface of the second metal tube 11 includes an opposed portion 111 that is opposed to a circumferential side surface of the target 9. The bonding material 8 in this embodiment is in contact with and extends over the opposed portion 111 of the second metal tube 11 and the step 100 of the first metal tube 10. The step 100 is a surface opposed to the electron irradiation surface 90 as a surface of the target 9 on the side to be irradiated with electrons.

The first metal tube 10 has a coefficient of thermal expansion that is smaller than that of the second metal tube 11, and thus, has a smaller amount of contraction as heat is dissipated therefrom after the bonding. Therefore, in the structure described above, by the contraction of the second metal tube 11 having a larger amount of contraction, the bonding material 8 is pushed by the end face of the first metal tube 10 on the front end side, and compressive stress acts on the bonding material 8 in a direction of a central axis of the target 9. This compressive stress acts in a circumferential direction of the target 9 in accordance with a Poisson's ratio to partly alleviate the tensile stress that acts on the bonding material 8 in the circumferential direction of the target 9. Therefore, a region with a smaller tensile stress is partly formed, and a probability of vacuum leakage due to crack development can be reduced.

Note that, when the first metal tube 10 has a Young's modulus that is larger than that of the second metal tube 11, such compressive stress is not absorbed by deformation of the first metal tube 10 and efficiently acts on the bonding material 8. Therefore, a mode in which the first metal tube 10 has a Young's modulus that is larger than that of the second metal tube 11 is more preferred because compression of the bonding material 8 in the tube axial direction is more likely to occur. For example, by forming the second metal tube 11 of copper and forming the first metal tube 10 of tungsten, both a difference in coefficient of thermal expansion and a difference in Young's modulus can be utilized.

FIG. 2A to FIG. 2D and FIG. 3A to FIG. 3C are illustrations of modified examples, respectively, of the anode according to the first embodiment, which are different from the basic form described above in the following points.

Figure 2A:
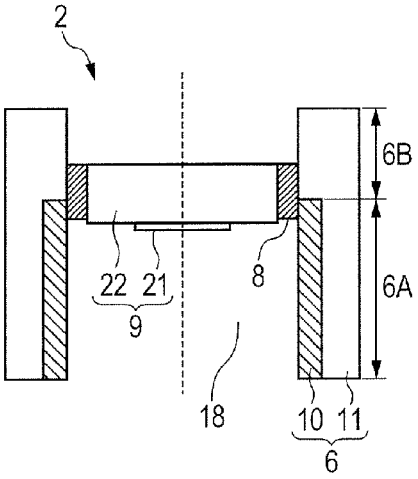
FIG. 2A is an illustration of Modified Example 1 of the anode according to the first embodiment.
Figure 2B:
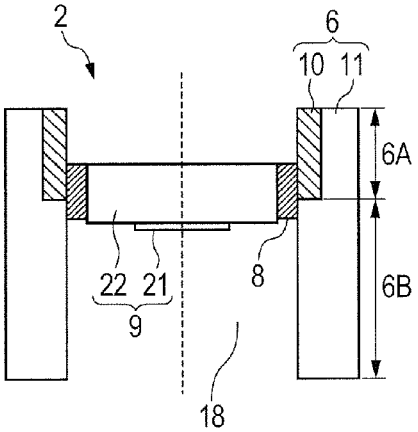
FIG. 2B is an illustration of Modified Example 2 of the anode according to the first embodiment.

In Modified Example 1 and Modified Example 2 illustrated in FIG. 2A and FIG. 2B, respectively, a structure of combination of the first metal tube 10 and the second metal tube 11 is different from that in the first embodiment. Specifically, an inner step is formed on the inner surface of the second metal tube 11, which divides the second metal tube 11 into a larger internal diameter portion 6A and a smaller internal diameter portion 6B, and the first metal tube 10 is connected to the larger internal diameter portion 6A. The inner step is formed correspondingly to a thickness of the first metal tube 10 in the tube radial direction, and thus, an inner surface of the first metal tube 10 and an inner surface of the smaller internal diameter portion 6B of the second metal tube 11 are continuous having a common internal diameter. Further, the target 9 is formed in the opening 18 in the anode member 6 under a state in which the circumferential side surface of the target base member 22 is opposed to the inner step. The bonding material 8 is arranged in a region that extends over the inner surface of the first metal tube 10 and the inner surface of the second metal tube 11 with the inner step therebetween. The target base member 22 is bonded to the inner surface of the first metal tube 10 and to the inner surface of the second metal tube 11 via the bonding material 8. In such a structure, a difference in coefficient of thermal expansion between the first metal tube 10 and the second metal tube 11 can cause compressive stress that acts on the bonding material 8 at a boundary among the first metal tube 10, the second metal tube 11, and the bonding material 8 along the direction of the central axis of the target 9. The compressive stress acts in the circumferential direction of the target 9 in accordance with the Poisson's ratio of the bonding material 8, and can partly alleviate the tensile stress that acts on the bonding material 8 in the circumferential direction of the target 9. Note that, Modified Example 1 illustrated in FIG. 2A and Modified Example 2 illustrated in FIG. 2B are different from each other in that the first metal tube 10 is arranged on a rear end side or a front end side of the anode member 6.

When, as illustrated in FIG. 2A, the larger internal diameter portion 6A is arranged at the back of the smaller internal diameter portion 6B and the inner surface of the first metal tube 10 is at the back of the inner surface of the second metal tube 11, even if the first metal tube 10 formed of a material having a large linear attenuation coefficient is formed so as to be longer, the X-ray irradiation region at the front is not impaired. Therefore, by forming the first metal tube 10 that is longer than that illustrated in FIG. 2B under a state in which the X-ray irradiation region equivalent to that illustrated in FIG. 2B is maintained, an amount of thermal deformation of the first metal tube 10 increases, and the tensile stress on the bonding material 8 can be alleviated more. As a result, a crack in the bonding material 8 and in the target base member 22 can be still less liable to develop.

Figure 2C:
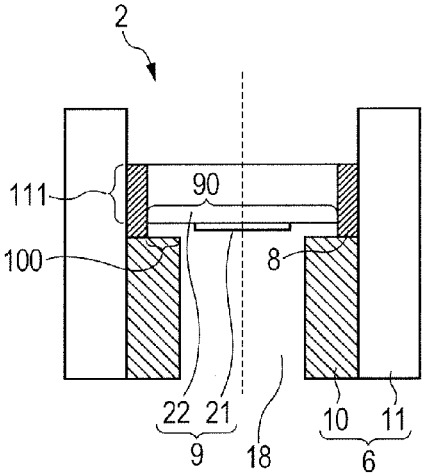
FIG. 2C is an illustration of Modified Example 3 of the anode according to the first embodiment.

In Modified Example 3 illustrated in FIG. 2C, a structure of combination of the first metal tube 10 and the second metal tube 11 is the same as that of the basic form, but the location of the target 9 and the region in which the bonding material 8 intervenes are different from those in the basic form. Specifically, similarly to the case of the basic form, the inner surface of the second metal tube 11 on the front end side has a region that is not covered with the first metal tube 10 and the bonding material 8 intervenes between the circumferential side surface of the target base member 22 and the inner surface of the region that is not covered with the first metal tube 10 of the second metal tube 11. However, Modified Example 3 is different from the basic form in that there is a gap between the target 9 and the end face of the first metal tube 10 on the front end side (step 100). Further, Modified Example 3 is also different from the basic form in that the bonding material 8 does not intervene between the target base member 22 and the end face of the first metal tube 10 on the front end side. In such a structure, the bonding material 8 is arranged on an outer side of the side surface of the target 9, and thus, the compressive stress is more likely to act on the entire bonding material 8, and a crack in the bonding material 8 and in the target base member 22 can be still less liable to develop.

Note that, the second metal tube 11 in this Modified Example 3 includes an opposed portion 111 opposed to a circumferential side surface of the target 9. The opposed portion 111 is bonded to the circumferential side surface of the target 9 via the bonding material 8.

Figure 2D:
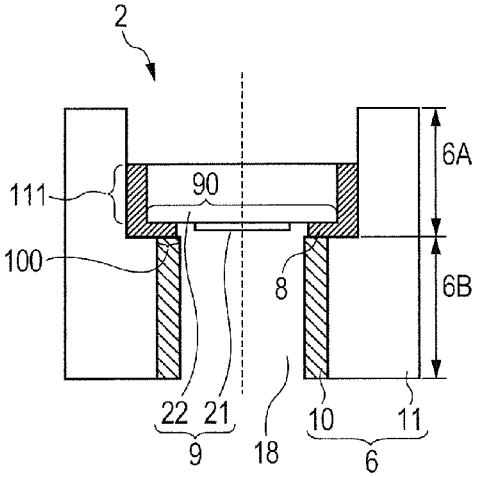
FIG. 2D is an illustration of Modified Example 4 of the anode according to the first embodiment.

In Modified Example 4 illustrated in FIG. 2D, an inner step is formed on the inner surface of the second metal tube 11, which divides the second metal tube 11 into the larger internal diameter portion 6A and the smaller internal diameter portion 6B, and the first metal tube 10 is connected to the smaller internal diameter portion 6B. The inner step is flush with the end face of the first metal tube 10 on the front end side. Together therewith, the bonding material 8 intervenes in a region from between the circumferential side surface of the target base member 22 and the inner surface of the larger internal diameter portion 6A of the second metal tube 11 to between the outer peripheral portion of the surface of the target 9 on the electron beam irradiation side and the end face of the first metal tube 10 on the front end side. The end face of the first metal tube 10 on the front end side in this Modified Example 4 has the step 100 that is opposed to the target 9 in the tube axial direction and overlaps the target 9 in the tube radial direction. Further, the inner surface of the second metal tube 11 includes the opposed portion 111 opposed to the circumferential side surface of the target 9 with a gap therebetween. The bonding material 8 in this Modified Example 4 is in contact with and extends over the opposed portion 111 of the second metal tube 11 and the step 100 of the first metal tube 10. In this structure, not only compressive stress that acts on the bonding material 8 sandwiched between the circumferential side surface of the target base member 22 and the inner surface of the larger internal diameter portion 6A of the second metal tube 11 but also compressive stress that acts on the bonding material 8 at the boundary between the second metal tube 11 and the first metal tube 10 alleviates the tensile stress. Therefore, a crack in the bonding material 8 and in the target base member 22 can be still less liable to develop.

Figure 3A:
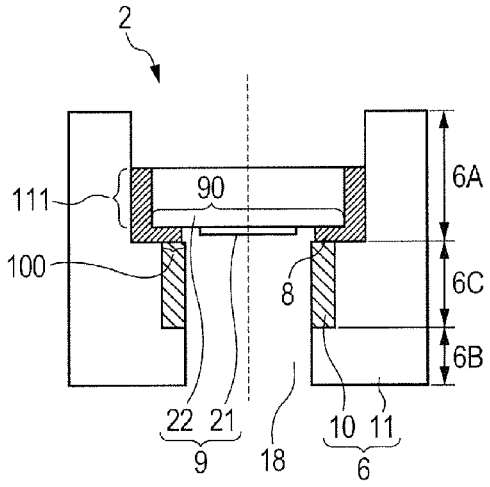
FIG. 3A is an illustration of Modified Example 5 of the anode according to the first embodiment.

In Modified Example 5 illustrated in FIG. 3A, two steps are formed on the inner surface of the second metal tube 11, which divide the second metal tube 11 into the larger internal diameter portion 6A, a medium internal diameter portion 6C, and the smaller internal diameter portion 6B, and the first metal tube 10 is connected to the medium internal diameter portion 6C. The end face of the first metal tube 10 on the front end side and the inner step between the larger internal diameter portion 6A and the medium internal diameter portion 6C are flush with each other, and the inner step between the medium internal diameter portion 6C and the smaller internal diameter portion 6B corresponds to a thickness of the first metal tube 10. Together therewith, the bonding material 8 intervenes in a region from between the circumferential side surface of the target base member 22 and the inner surface of the larger internal diameter portion 6A of the second metal tube 11 to between the outer peripheral portion of the surface of the target base member 22 on the electron beam irradiation side and the end face of the first metal tube 10 on the front end side. In this Modified Example 5, the region of the second metal tube 11 and the first metal tube 10 in contact with the bonding material 8 is substantially similar to that in Modified Example 4 illustrated in FIG. 2D. In such a structure, as the second metal tube 11 contracts, the end face of the first metal tube 10 on the front end side can be pressed against the bonding material 8. As a result, the tensile stress can be further alleviated and a crack in the bonding material 8 and in the target base member 22 can be still less liable to develop.

Figure 3B:
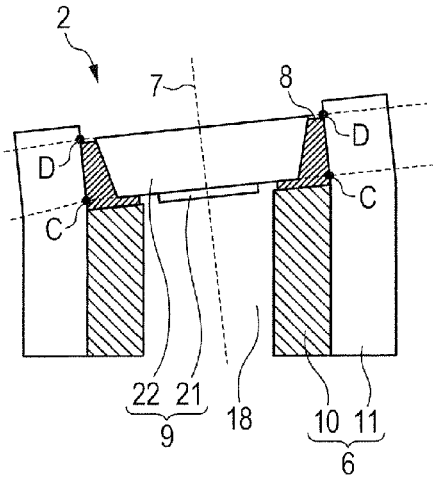
FIG. 3B is an illustration of Modified Example 6 of the anode according to the first embodiment.
Figure 3C:
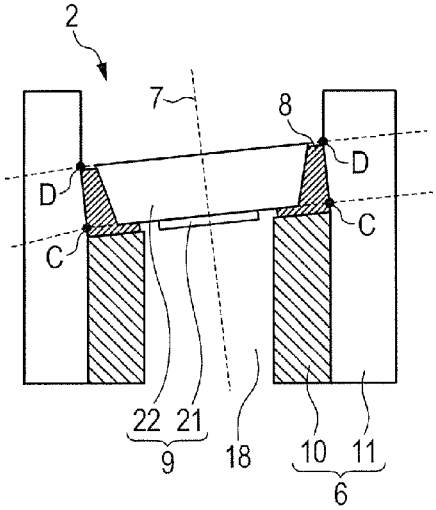
FIG. 3C is an illustration of Modified Example 7 of the anode according to the first embodiment.

In Modified Examples 6 and 7 illustrated in FIG. 3B and FIG. 3C, respectively, a central axis 7 of the opening 18 in a region in which the target 9 is bonded is slanted with respect to the central axis of the opening 18 in the remaining region. In both cases, the target 9 is bonded under a state in which the central axis thereof is in a slanted state in accordance with the slanted central axis 7 in the opening 18. Here, the central axis 7 of the opening 18 in a region in which the target 9 is bonded is described. As illustrated in FIG. 3B and FIG. 3C, an innermost line of intersection of an extension of the surface of the target base member 22 on the target layer 21 side (surface on the electron beam irradiation side) and the anode member 6 is referred to as a closed curve C. An innermost line of intersection of an extension of the surface of the target base member 22 on the X-ray emission side and the anode member 6 is referred to as a closed curve D. A straight line passing through a center of the closed curve C and a center of the closed curve D is referred to as the central axis 7. In Modified Example 6 illustrated in FIG. 3B, the central axis 7 is slanted by slanting the front end side of the second metal tube 11. In Modified Example 7 illustrated in FIG. 3C, the central axis 7 is slanted by changing a thickness of an intermediate portion of the second metal tube 11. Even when the central axis 7 is slanted in this way, if a structure illustrated in any one of FIG. 2A to FIG. 2D and FIG. 3A is realized, a portion that can alleviate the tensile stress on the bonding material 8 can be formed, and a crack in the bonding material 8 and in the target base member 22 can be less liable to develop.

Among the examples described above, in the examples illustrated in FIG. 2A and FIG. 2B, the location of the first metal tube 10 is upside down, which can also be said that the target 9 is oriented oppositely. Similarly, the target 9 can be oriented oppositely in the first embodiment described with reference to FIG. 1A and FIG. 1B, Modified Examples 1 to 4 described with reference to FIG. 2A, FIG. 2B, FIG. 2C, and FIG. 2D, respectively, and Modified Examples 5 to 7 described with reference to FIG. 3A, FIG. 3B, and FIG. 3C. The target layer 21 is oriented downward in every one of the targets 9 illustrated in the figures, but the target layer 21 may be oriented upward.

Anode According to Second Embodiment

Figure 4:
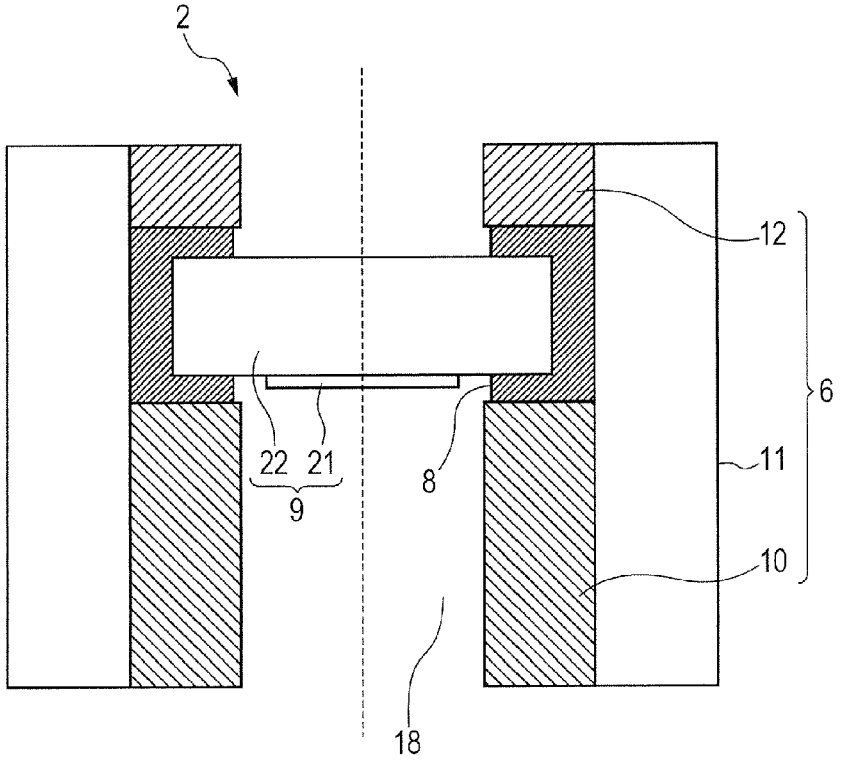
FIG. 4 is a sectional view for illustrating an exemplary anode according to a second embodiment of the present invention.

As illustrated in FIG. 4, in the anode according to a second embodiment of the present invention, in addition to the first metal tube 10 and the second metal tube 11, a third metal tube 12 having a coefficient of thermal expansion that is smaller than that of the second metal tube 11 is used. Further, the peripheral portion of the target 9 is bonded to the anode member 6 via the bonding material 8 that is arranged so as to extend over the first metal tube 10, the second metal tube 11, and the third metal tube 12. Specifically, under a state in which the inner surface of the second metal tube 11 has a region that is not covered with the first metal tube 10, the first metal tube 10 and the third metal tube 12 are, in series, fit into the second metal tube 11, with the third metal tube 12 being on the front end side of the second metal tube 11. There is a gap between the first metal tube 10 and the third metal tube 12, and, in the gap, the inner surface of an intermediate portion of the second metal tube 11 has the region that is not covered with the first metal tube 10. Further, the peripheral portion of the target 9 inserted in the gap is bonded to the anode member 6 via the bonding material 8 that intervenes in a region from the end face of the first metal tube 10 through the inner surface of the second metal tube 11 to an end face of the third metal tube 12. In such a structure, the compressive stress can act under a state in which the bonding material 8 is sandwiched between the first metal tube 10 and the third metal tube 12, and thus, a region with a smaller tensile stress increases more, and a crack in the bonding material 8 and in the target base member 22 can be still less liable to develop. Further, the third metal tube 12 is farther from the target layer 21 than the first metal tube 10 is. Therefore, when the X-ray is generated, temperature rise due to heat generated by the irradiation region of the electron beam 17 is relatively small, and thus, a stress amplitude caused in the bonding material 8 is small and metal fatigue is less liable to be caused.

Note that, similarly to the first metal tube 10, the third metal tube 12 can have a Young's modulus that is larger than that of the second metal tube 11. In such a structure, the second metal tube 11 has a Young's modulus that is smaller than those of the first metal tube 10 and of the third metal tube 12, and thus, the compressive stress is not absorbed by deformation of the first metal tube 10 and of the third metal tube 12 and efficiently acts on the bonding material 8. Therefore, a mode in which the third metal tube 12 has, similarly to the first metal tube 10, a Young's modulus that is larger than that of the second metal tube 11 is more preferred because compression of the bonding material 8 in the tube axial direction is more likely to occur. For example, by forming the second metal tube 11 of copper and forming the first metal tube 10 and the third metal tube 12 of tungsten, both a difference in coefficient of thermal expansion and a difference in Young's modulus can be utilized.

Note that, the broken line in FIG. 1B is a center line passing through a center of an internal diameter of the tubular anode member 6, and shows the tube axial direction of the tubular anode member 6.

In the anode according to each of the first embodiment and the second embodiment described above, from the viewpoint of causing the compressive stress to be more likely to act on the bonding material 8, it is preferred that the third metal tube 12 have a coefficient of thermal expansion that is smaller than that of the bonding material 8. Further, it is preferred that the first metal tube 10 have a coefficient of thermal expansion that is smaller than that of the bonding material 8. Still further, it is preferred that the second metal tube 11 have a coefficient of thermal expansion that is smaller than that of the bonding material 8.

<X-Ray Generating Apparatus>

FIG. 5 is an illustration of an embodiment of the X-ray generating apparatus 101 for emitting the X-ray flux from an X-ray transmission window 121. The X-ray generating apparatus 101 in this embodiment includes the X-ray generating tube 102 as an X-ray source and the tube voltage circuit 103 for driving the X-ray generating tube 102 both in a container 120 with the X-ray transmission window 121.

It is preferred that the container 120 for containing the X-ray generating tube 102 and the tube voltage circuit 103 have a strength sufficient for a container and have excellent heat dissipation performance, and, as a material thereof, a metal material such as brass, iron, or a stainless steel is suitably used.

In this embodiment, space in the container 120 except space necessary for placing the X-ray generating tube 102 and the tube voltage circuit 103 is filled with an insulating liquid 109. The insulating liquid 109 is an electrically insulating liquid, and plays a role in maintaining electrical insulation in the container 120 and a role as a cooling medium of the X-ray generating tube 102. It is preferred that, electrically insulating oil such as a mineral oil, a silicone oil, or a perfluoro oil be used as the insulating liquid 109.

<X-Ray Imaging System>

Figure 6:
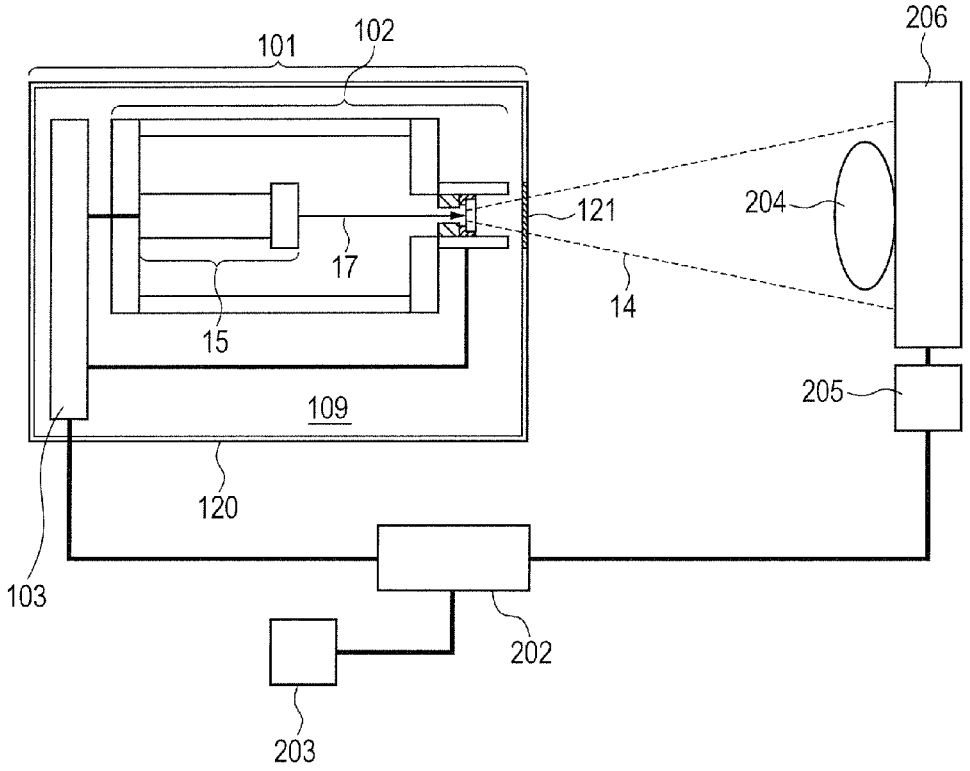
FIG. 6 is an X-ray imaging system including the X-ray generating apparatus according to the present invention.

FIG. 6 is a block diagram of an X-ray imaging system according to the present invention.

A system control device 202 integrally controls the X-ray generating apparatus 101 and an X-ray detector 206, and controls the X-ray generating apparatus 101 and other related apparatus in a coordinated manner. The system control device 202 is connected to the X-ray generating tube 102 via the tube voltage circuit 103, and controls X-ray generating operation of the X-ray generating apparatus 101. The X-ray flux 14 emitted from the X-ray generating apparatus 101 passes through a subject 204, to thereby be detected by the X-ray detector 206. The X-ray detector 206 converts the detected X-ray flux 14 into image signals and outputs the image signals to a signal processing portion 205. Under the control of the system control device 202, the signal processing portion 205 applies predetermined signal processing to the image signals, and outputs the processed image signals to the system control device 202. Based on the processed image signals, the system control device 202 outputs display signals to a display device 203 for displaying an image on the display device 203. The display device 203 displays on a screen an image of the subject 204 based on the display signals.

The peripheral portion of the target according to the present invention blocks the opening in the anode member and is bonded to the anode member. Further, the anode member includes the first metal tube and the second metal tube having a coefficient of thermal expansion that is larger than that of the first metal tube. The target is bonded to the anode member via the bonding material that is arranged so as to extend over the two. As the bonding material is cooled and contracted, a tensile stress acts on the bonding material along the circumferential direction of the target. At the same time, a difference in coefficient of thermal expansion between the first metal tube and the second metal tube can cause the compressive stress in, for example, the tube axial direction, to act on the bonding material. Further, the second metal tube has a Young's modulus that is smaller than that of the first metal tube. Therefore, the compressive stress is not absorbed by deformation of the first metal tube and efficiently acts on the bonding material. The compressive stress acts on the bonding material and the compressive stress in accordance with the Poisson's ratio of the bonding material acts in the circumferential direction of the target to alleviate the tensile stress. As a result, an X-ray generating tube can be provided in which a crack in the bonding material is less liable to develop and vacuum leakage is inhibited.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-147339, filed Jul. 18, 2014, and Japanese Patent Application No. 2015-119318, filed Jun. 12, 2015, which are hereby incorporated by reference herein in their entirety.

What is claimed is:

1. A transmission X-ray generating tube, comprising an anode including: a target for generating an X-ray through irradiation of an electron beam from an electron emitting source; and a tubular anode member having an opening for holding the target, the tubular anode member including a first metal tube, and a second metal tube fixed to the first metal tube and having a coefficient of thermal expansion that is larger than a coefficient of thermal expansion of the first metal tube, wherein a peripheral portion of the target is bonded to the tubular anode member via a bonding material arranged so as to extend over the first metal tube and the second metal tube.

2. The X-ray generating tube according to claim 1, wherein an inner surface of the second metal tube and an outer surface of the first metal tube are fixed to each other so that the first metal tube and the second metal tube are prevented from moving relative to each other at a melting point of the bonding material.

3. The X-ray generating tube according to claim 2, wherein the first metal tube has a length that is smaller than a length of the second metal tube in a tube axial direction of the tubular anode member.

4. The X-ray generating tube according to claim 2, wherein the first metal tube includes a step that is opposed to the target in a tube axial direction and that overlaps the target in a tube radial direction, wherein the inner surface of the second metal tube includes an opposed portion that is opposed to a circumferential side surface of the target with a gap therebetween, and wherein the bonding material is in contact with the opposed portion and the step.

5. The X-ray generating tube according to claim 4, wherein the target includes an electron irradiation surface that has a portion to be irradiated with electron beam emitted from the electron emitting source and that is communicated to the circumferential side surface annularly, and wherein the step is opposed to the electron irradiation surface.

6. The X-ray generating tube according to claim 1, wherein the bonding material is in contact with and extends over an inner surface of the first metal tube and an inner surface of the second metal tube.

7. The X-ray generating tube according to claim 1, wherein the second metal tube extends over a connecting portion connected to the target from an atmosphere side to a vacuum side of the tubular anode member, and wherein the first metal tube is located on the vacuum side of the tubular anode member with respect to the connecting portion.

8. The X-ray generating tube according to claim 1, further comprising a third metal tube having a coefficient of thermal expansion that is smaller than the coefficient of thermal expansion of the second metal tube, wherein the third metal tube, the target, and the first metal tube are arranged in this order along a tube axial direction of the second metal tube.

9. The X-ray generating tube according to claim 8, wherein the third metal tube has a coefficient of thermal expansion that is smaller than a coefficient of thermal expansion of the bonding material.

10. The X-ray generating tube according to claim 1, wherein the first metal tube has a coefficient of thermal expansion that is smaller than a coefficient of thermal expansion of the bonding material.

11. The X-ray generating tube according to claim 1, wherein the second metal tube has a coefficient of thermal expansion that is smaller than a coefficient of thermal expansion of the bonding material.

12. The X-ray generating tube according to claim 1, wherein the bonding material comprises a brazing material.

13. The X-ray generating tube according to claim 1, wherein the target includes a target layer for generating an X-ray through irradiation of electrons and a target base member for supporting the target layer, and wherein the target base member comprises a diamond substrate.

14. The X-ray generating tube according to claim 1, wherein the second metal tube has a Young's modulus that is smaller than a Young's modulus of the first metal tube.

15. The X-ray generating tube according to claim 1, wherein the first metal tube and the second metal tube are formed so as to cause the bonding material to produce a compressive stress component on at least one end portion side of the tubular anode member in a direction along a tube axis thereof, to thereby alleviate a tensile stress of the bonding material acting in a circumferential direction of the tubular anode member.

16. An X-ray generating apparatus comprising:

the transmission X-ray generating tube according to claim 1; and a tube voltage circuit, wherein the tube voltage circuit is electrically connected to each of the target and the electron emitting source, for applying a tube voltage between the target and the electron emitting source.

17. An X-ray imaging system comprising:

the X-ray generating apparatus according to claim 16;

an X-ray detector for detecting an X-ray that is emitted from the X-ray generating apparatus and passes through a subject; and a system control device for integrally controlling the X-ray generating apparatus and the X-ray detector.

18. The X-ray generating tube according to claim 1, wherein each of the first metal tube and the second metal tube shows a higher melting temperature than that of the bonding material.

19. A transmission X-ray generating tube, comprising an anode including: a target for generating an X-ray through irradiation of an electron beam from an electron emitting source; and a tubular anode member having an opening for holding the target, the tubular anode member including a first metal tube, and a second metal tube fixed to the first metal tube and having a coefficient of thermal expansion that is larger than a coefficient of thermal expansion of the first metal tube, wherein a peripheral portion of the target is bonded to the tubular anode member via a brazing material arranged so as to extend over the first metal tube and the second metal tube.

20. The X-ray generating tube according to claim 19, further comprising a third metal tube having a coefficient of thermal expansion that is smaller than the coefficient of thermal expansion of the second metal tube, wherein the third metal tube, the target, and the first metal tube are arranged in this order along a tube axial direction of the second metal tube, and wherein the third metal tube has a coefficient of thermal expansion that is smaller than a coefficient of thermal expansion of the brazing material.

21. The X-ray generating tube according to claim 19, wherein the first metal tube has a coefficient of thermal expansion that is smaller than a coefficient of thermal expansion of the brazing material.

22. The X-ray generating tube according to claim 19, wherein the second metal tube has a coefficient of thermal expansion that is smaller than a coefficient of thermal expansion of the brazing material.

* * * * *